US011271302B2

(12) United States Patent
Judd

(10) Patent No.: US 11,271,302 B2
(45) Date of Patent: Mar. 8, 2022

(54) WIDEBAND WAVE CONSTRUCTION METHOD FOR CONTROLLING, ROTATING, OR SHAPING RADIO FREQUENCY OR ACOUSTIC WAVES IN FREE SPACE OR IN A FLUID

(71) Applicant: Mano Judd, Heath, TX (US)

(72) Inventor: Mano Judd, Heath, TX (US)

(73) Assignee: Mano D. Judd, Heath, TX (US)

( * ) Notice: Subject to any disclaimer, the term of this patent is extended or adjusted under 35 U.S.C. 154(b) by 0 days.

(21) Appl. No.: 16/918,017

(22) Filed: Jul. 1, 2020

(65) Prior Publication Data

US 2022/0006186 A1 Jan. 6, 2022

(51) Int. Cl.

| | |
|---|---|
| ***H01Q 3/36*** | (2006.01) |
| ***H01Q 5/25*** | (2015.01) |
| ***H01Q 3/24*** | (2006.01) |
| ***H01Q 3/40*** | (2006.01) |

(52) U.S. Cl.

CPC ..... *H01Q 3/36* (2013.01); *H01Q 3/24* (2013.01); *H01Q 3/40* (2013.01); *H01Q 5/25* (2015.01)

(58) Field of Classification Search

CPC .. H01Q 3/36; H01Q 3/24; H01Q 3/40; H01Q 5/25

See application file for complete search history.

(56) References Cited

U.S. PATENT DOCUMENTS 4,983,986 A * 1/1991 Woloszczuk ..... H01Q 13/18 343/771
5,459,474 A * 10/1995 Mattioli ..... H01Q 21/0025 343/702
5,489,913 A * 2/1996 Raguenet ..... H01Q 13/18 343/767
6,421,021 B1 * 7/2002 Rupp ..... H01Q 13/085 343/753
6,424,090 B1 * 7/2002 Sklyarevich ..... H01J 25/025 315/4
6,492,949 B1 * 12/2002 Breglia ..... G01S 13/346 343/700 MS
6,670,910 B2 * 12/2003 Delcheccolo ..... G01S 7/06 342/70
6,864,831 B2 * 3/2005 Woodington ..... H01Q 1/42 342/70
6,970,142 B1 * 11/2005 Pleva ..... G01S 7/032 343/700 MS
6,977,609 B2 * 12/2005 Pleva ..... H01Q 1/3233 342/28
6,987,485 B2 * 1/2006 Ito ..... H01Q 1/243 343/702
6,995,730 B2 * 2/2006 Pleva ..... G01S 7/032 343/853
7,183,995 B2 * 2/2007 Pleva ..... G01S 7/032 342/374

(Continued)

*Primary Examiner* — Lam T Mai

(57) ABSTRACT

In patent application Ser. No. 15,934563, a method was developed that achieves wave rotation or shaping in the near field and far field, for narrowband RF Signals. That is, using an acoustic or RF phased array, the effective wavefront can be rotated from the propagation normal, at a selected location region in space. In this innovation, the application has been extended to Wideband Signals, where the signal bandwidths can highly exceed the one-percent of carrier frequency narrowband threshold.

7 Claims, 11 Drawing Sheets

(56) References Cited

U.S. PATENT DOCUMENTS

| | | | | |
|---|---|---|---|---|
| 7,647,954 | B2 * | 1/2010 | Garber | B67D 7/348<br>141/94 |
| 8,325,098 | B1 * | 12/2012 | Henrie | H04B 17/12<br>343/703 |
| 2012/0019731 | A1 * | 1/2012 | Imai | H04N 5/64<br>348/726 |

* cited by examiner

WIDEBAND WAVE CONSTRUCTION METHOD FOR CONTROLLING, ROTATING, OR SHAPING RADIO FREQUENCY OR ACOUSTIC WAVES IN FREE SPACE OR IN A FLUID

The present application claims priority to the earlier filed provisional application having Ser. No. 62/872470, and hereby incorporates subject matter of the provisional application in its entirety.

BACKGROUND

Within a phased array, either a Radio Frequency (RF) antenna or (very low frequency) acoustic array, the magnitude and phase of a relationship resulting from the weighted sum of some or all array elements, are employed to derive a pre-determined value for the wave magnitude and phase of a far field multiplicity of points in space or within a fluid. For an RF system, this can be an electric field magnitude for a far field multiplicity of points in space. For an acoustic system, this can be the pressure wave of a far field multiplicity of points in either space (air) or within a fluid (such as water, or the ocean). However, independent of any set of weights that are computed for the array beam, the far field wavefronts that impinge on the target or receiver will always be orthogonal to the direction of propagation of the wave. This direction of propagation is exactly the vector from the transmitting source antenna or array, to the target location or receiver antenna.

In patent application Ser. No. 15,934563, *a* method has been developed that achieves wave rotation or shaping, in the near field as well as the far field. This new capability, allows the far field wave to be manipulated such that the impinging wavefronts (or wave crests) at the target or receive antenna or array, are not orthogonal (perpendicular) to the direction of propagation. However, this application was derived and specified for only the Narrowband Signal model. Thus, to date, there has been no solution that can generate far field (or near field) wavefront rotation, that is operational and consistent along a wideband frequency range.

In this novel development, the signal model has been extended to the Wideband Signal domain, and uses a Discrete Fourier Transform (DFT) to compute the array weights, independently for each frequency bin, and then to inverse transform these spectral based weights back to the time domain. Therefore, a single set of weights, for the time domain are produced which accurately rotate or shape the waves in space over nearly any desired signal bandwidth.

Applications include, but are not limited, to spoofing or fooling (RF) Surface to Air Missile systems, incoming missiles, and (Acoustic) decoys to fool torpedo's or submarine acoustic detection and tracking systems.

BRIEF SUMMARY OF THE INVENTION

The conventional RF beamformer is a delay and sum mechanism for an array, that receives or generates (radiates) signal energy from M antennas and controls and varies the phase of the M radiated waves to produce constructive interference at a given far field point or line. This produces an array "beam" with coherent phasing virtually out to infinity (distance). The key point is that the phasing and control of the array antenna element's phase and amplitudes, using a set of complex digital array weights, (h), is to produce this constructive interference event at a single point, or single line (from the array to the far field point). This is shown in FIG. 1. This information is common and known to professionals in the field of spatial Digital Signal Processing (DSP), Antenna Array design, or those skilled in the art.

In the original patent application Ser. No. 15,934563, denoted as the Wave Mechanics technique, it was shown that a radiating signal can be constructed, from a phased array system of M antennas (or transducers, for acoustics), such that the far field wave at a given point is rotated by a predetermined or computed angle, (β). This is shown in FIG. 2.

This rotated wave has all the properties of the natural wave, and is therefore received by the passive direction finding system or radar, with an estimated angle that is not perpendicular to the source direction of wave propagation. The Wave Mechanics technology uses phase and amplitude control and variation, at each antenna element within the array and produces simultaneous summing and constructive (and/or destructive) interference at a multiplicity of pre-determined (calculated) points in the Far Field. This in effect also produces the same summing or interference at all points between and around the pre-determined points, to appear as a "wall" of a controlled and directed wave front. All of the different far field point Electric field values are formed from the same set of complex weights, h. The Wave Mechanics technique generates a collection or multiplicity of points, from a single set of M complex weights, h, from a multiplicity of (M) RF antennas, or acoustic transducers. These points emulate the same in-phase characteristics as the natural expanding wave, but either rotated or "wrapped" onto a different virtual surface; that is not perpendicular to the location of the transmitting array. For the case of the rotated wave, the Wave Mechanics technique generates an actual wavefront, that is however, rotated from the natural wave, at a preset/pre-calculated rotation angle, β.

In this extension to the technology, rather than computing a set of weights that only work within a very narrow frequency bandwidth, example for a signal bandwidth much less than 1 percent of the carrier frequency, the inventor has developed a technique to force the same rotation angle, but along a very wide frequency via exploiting the Discrete Fourier Transform (DFT) of the original signal. It can be shown that this technique would work for signal bandwidths much larger than 1 percent of the carrier frequency.

BRIEF DESCRIPTION OF THE DRAWINGS

FIG. 4. illustrates a multiplicity of RF antennas, as an array, and the far field point at which the Wave Mechanics process is applied to.

DETAILED DESCRIPTION AND BEST MODE OF IMPLEMENTATION

Figure 1:
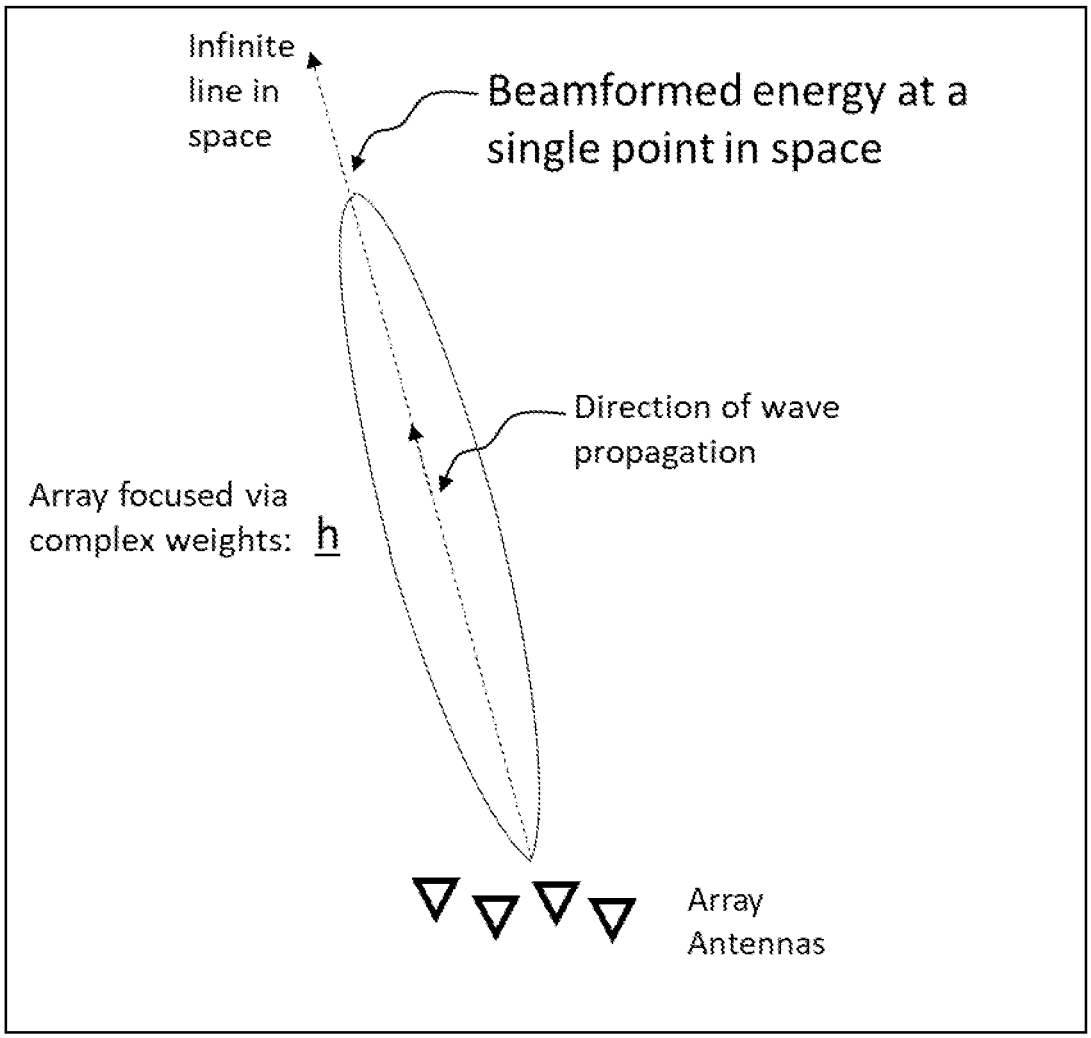
FIG. 1. shows a conventional RF Beamformer.
Figure 2:
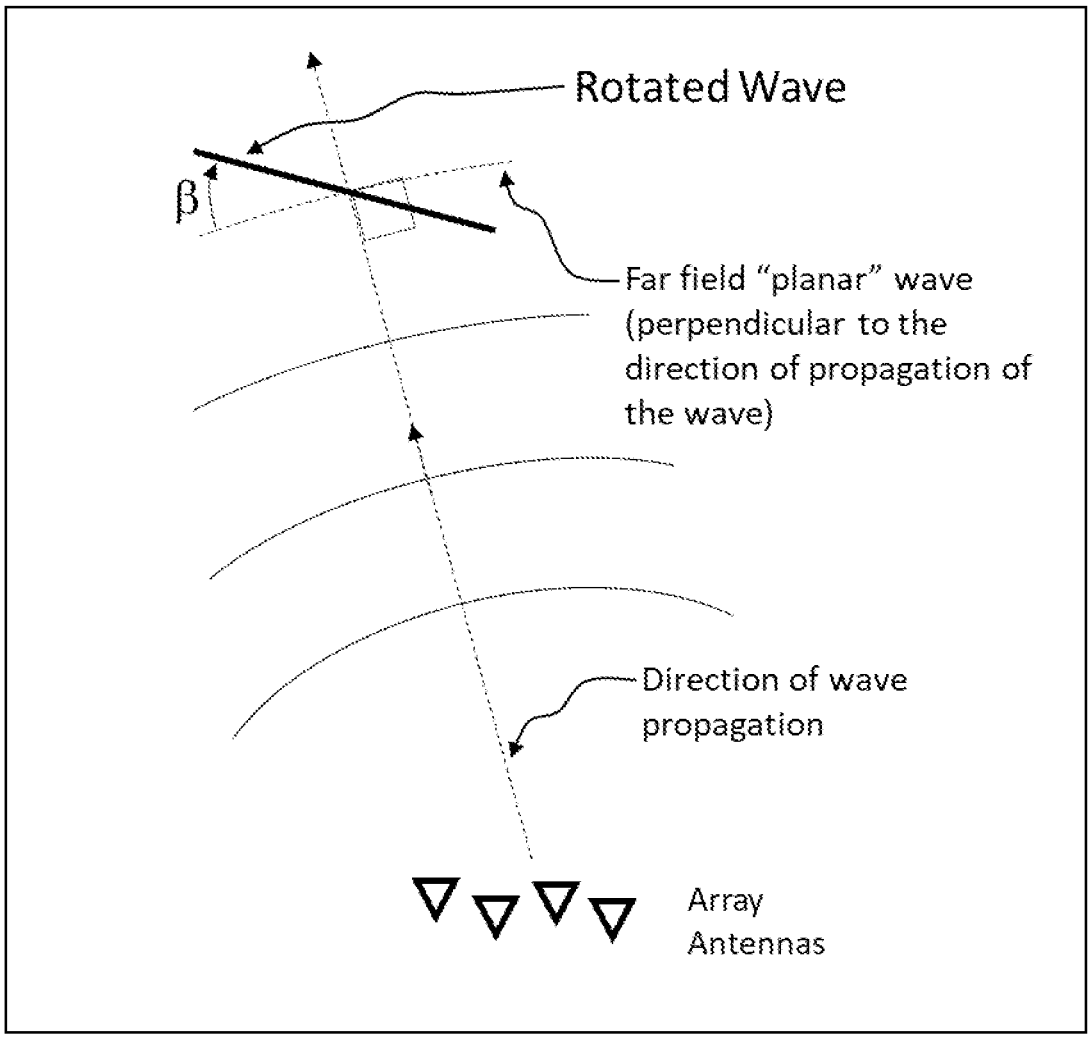
FIG. 2. illustrates a radiating signal constructed from a phased array of antennas, where the far field wave is rotated at a given point by a computed angle.
Figure 3:
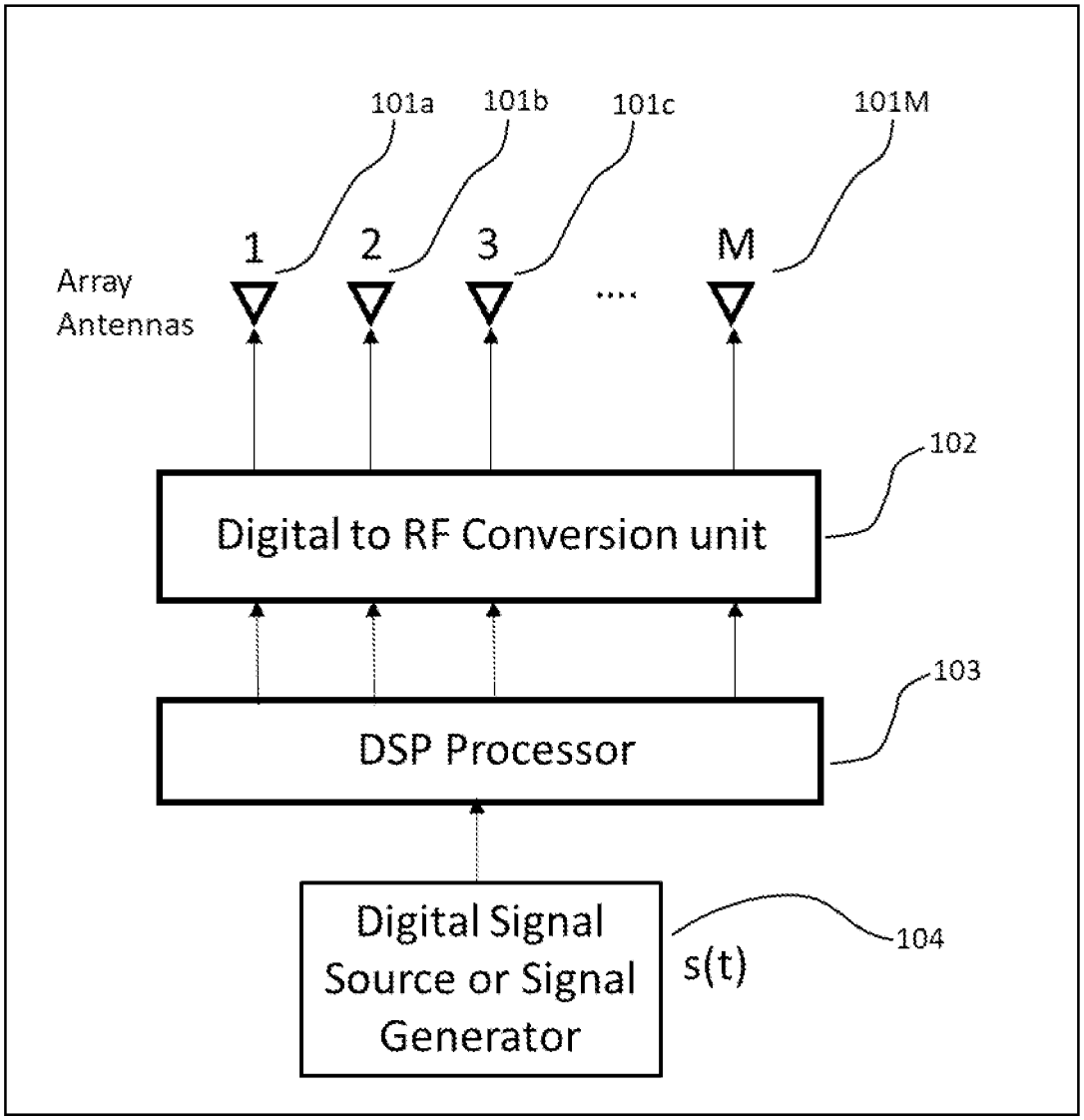
FIG. 3. shows a block diagram of one embodiment of the Wave Mechanics transmission system for an antenna array/RF system.

Similar to the previous patent application Ser. No. 15,934563, FIG. 3 shows the block diagram of one embodiment of the Wave Mechanics transmission system; for an antenna/array (RF) system. This is comprised of a multiplicity of M antenna elements, 101*a* through 101M, each fed by a coherent (in phase) RF converted signal. Without loss of generality, it should be noted that all of the M antennas do not need to be co-located, but can be placed on two or more platforms. This embodiment of the present invention includes, but is not limited to, baseband signal conversion to RF, for a multiplicity (array) of antennas. The source signal generator, 104, produces a digital signal that is processed by the DSP processing block, 103, which also multiplies the signal, s(t), by the weight vector, h, and forwards each antenna signal to the Digital to RF converter block, 102.

In a general sense, migration to a wideband system does not change this system configuration, since no bandwidth constraints have specified for the Digital RF Conversion System. In fact, most of the changes would exist at the DSP level (103) and (104), with DFT processing and techniques replacing narrowband processing methods.

The Wideband Wave Mechanics process still results in a weight vector computed, that when multiplied by the input signal, s(t), results in a wideband signal generated with a constant or near constant rotation angle throughout the wideband signal bandwidth. Therefore, similar to the original patent, using a narrowband signal model, the Digital Signal Processing (DSP) processor both computes the optimal weight vector, h, as well as performs the real time multiplication at the baseband sample rate, of:

output=h(t)·s(t)

for the wideband signal, s(t).

The Narrowband development for the Wave Mechanics mechanism is described as follows:

The process inputs the digitized signal, s(t), copies the signal M times, and multiplies each sample; for the same time instant, by $h_i$, where i=1, 2, . . . , M is the antenna reference number.

Note, this is similar to the conventional beamformer process, however only in the generation of the output (s(t)·h). For the Wave Mechanics technology, h is generated completely different from the method the conventional beamformer uses to compute h.

For a tone that is transmitted (radiated) from an Antenna #1, at a distance, r, in the far field from the antenna, the field voltage for any far field distance (r) frequency (f) and time (t) can be represented as a traveling wave:

$$V(r, f, t) = \frac{1}{r} e^{j(kw+\omega t)}$$

In volts per meter. Where:

r=displacement (distance) from antenna #1 to a given point f=frequency of the wave t=time.

Where r>>λ: the far field definition. The wavelength can be written in terms of the speed of light, c, and frequency, f, as:

$$\lambda = \frac{c}{f}$$

for acoustics, c would be the speed of sound in the fluid or air.

Figure 4:
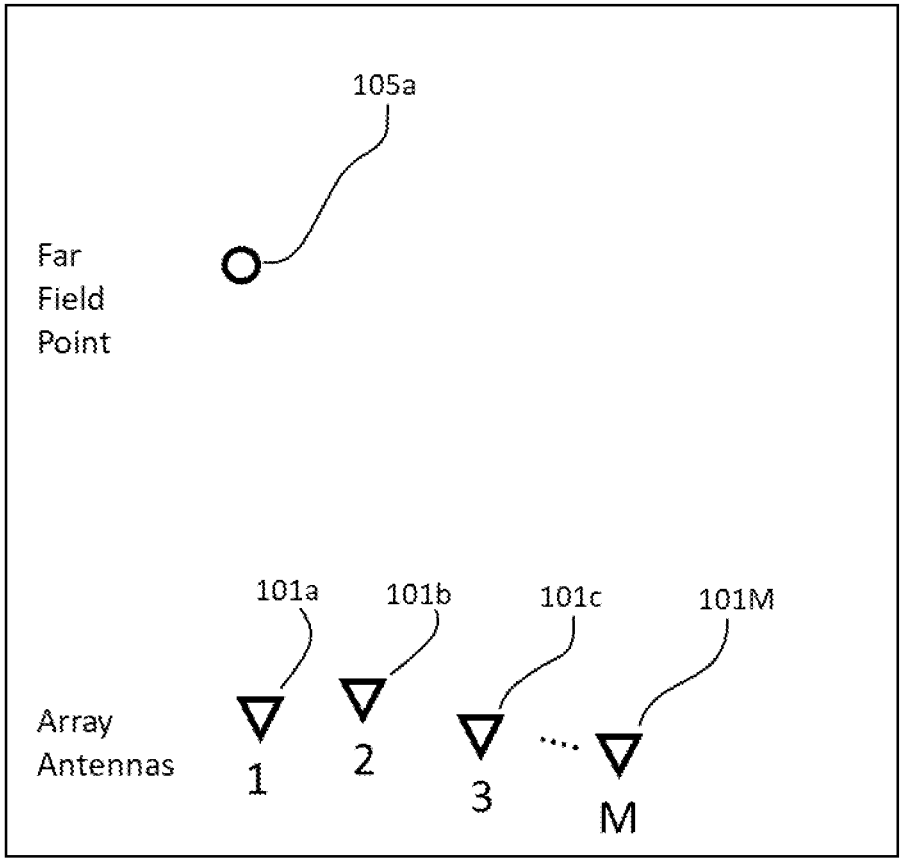

FIG. 4 illustrates a multiplicity of RF antennas, 101*a* through 101M, as an array, and the far field point, 105*a,* at which the Wave Mechanics process is to be applied to.

Figure 5:
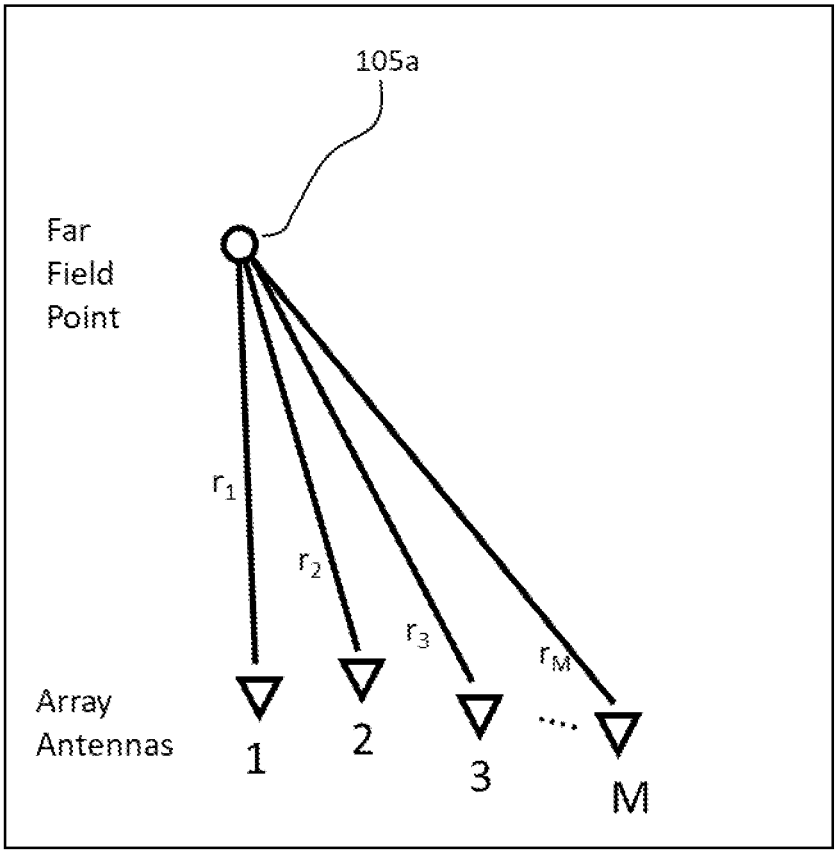
FIG. 5. shows the lengths and the resulting voltage at the far field point.

As shown in FIG. 5, the lengths can be denoted as $r_1$, $r_2$, $r_M$ and resulting voltage at the far field point as:

$$V(f) = \frac{1}{r_1} e^{(kr_1+\omega t_1)} + \frac{1}{r_2} e^{(kr_2+\omega t_2)} + \ldots + \frac{1}{r_M} e^{(kr_M+\omega t_M)}$$

This is the voltage sum, from the M antennas, each with a different distance, $r_i$, and wave reference time, $t_i$. Assume that the transmitted signals from each antenna are now coherent (e.g. synchronized in time), then $t=t_1=t_2=\ldots t_M$ Relationship [00043] can therefore be expressed as:

$$V(f, t) = \frac{1}{r_1} e^{(kr_1+\omega t)} + \frac{1}{r_2} e^{(kr_2+\omega t)} + \ldots + \frac{1}{r_M} e^{(kr_M+\omega t)}$$

By weighing each signal, transmitted from each antenna, with vector $h=[h_1, h_2, \ldots, h_M]$, the weighted sum for (s) can be expressed as:

$$V_W(f, t) = h_1 \frac{1}{r_1} e^{(kr_1+\omega t)} + h_2 \frac{1}{r_2} e^{(kr_2+\omega t)} + \ldots + h_M \frac{1}{r_M} e^{(kr_M+\omega t)}$$

This can be expressed in vector form as:

$$V_W(f, t) = \underset{1\times M}{[h_1\ h_2 \ldots\ h_M]} \underset{M\times 1}{\begin{bmatrix} \frac{1}{r_1} e^{(kr_1+\omega t)} \\ \vdots \\ \frac{1}{r_M} e^{(kr_M+\omega t)} \end{bmatrix}}$$

Or in compact form:

$V_w(f,t)=h^T \cdot V(f,t)$

The scalar $V_w(f, t)$ is a maximum when h =conjugate[V (f,t)]. This is an example of simple (conventional) RF beamforming. Without loss of generality, this derivation and expression also applies to acoustic beamforming.

Figure 6:
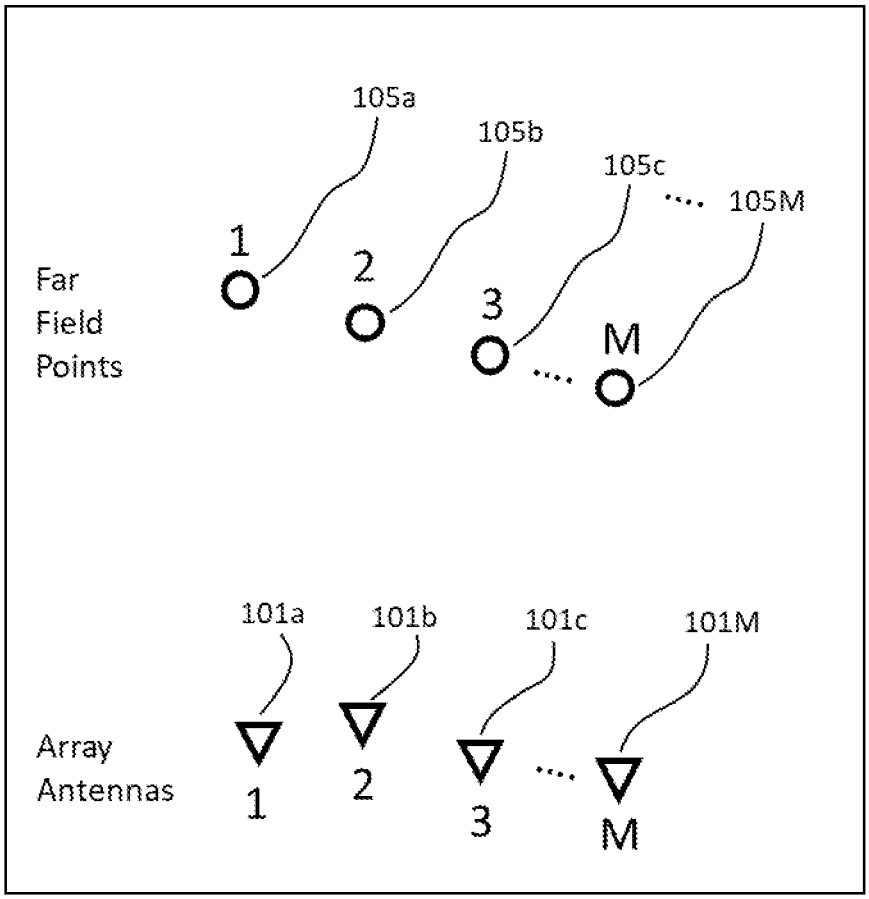
FIG. 6 illustrates how Wave Mechanics operates by generating a collection of points in the far field.

Wave Mechanics operates by generating a collection of points in the far field. This is shown by FIG. 6.

Note that the drawing shows the Fair Field points close to the array antennas. For sake of argument, and not requiring a very large drawing, it should be noted that the actual distance from the multiplicity of antennas, 101*a* through 101M, to the multiplicity of far field points, 105*a* through 105M, would be much larger than the physical size of the array of antennas.

For consistency, the two dimensional displacement vector will be denoted by using the convention of:

$r_{ij}=r_{to,from}$

Figure 7:
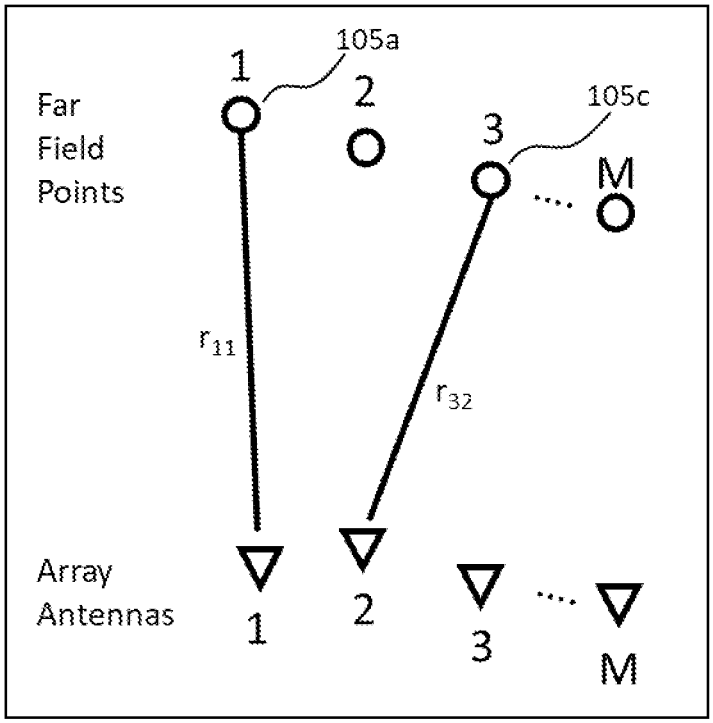
FIG. 7 shows the "from" value as the antenna number and the "to" value as the reference point in the field.

That is, the second component in the subscript is the value of the antenna reference number in the array, and the second component in the subscript is the referenced far field point. Thus the "from" value is the antenna (number), and the "to" value is the reference point in the far field. This is shown more clearly in FIG. 7.

Figure 8:
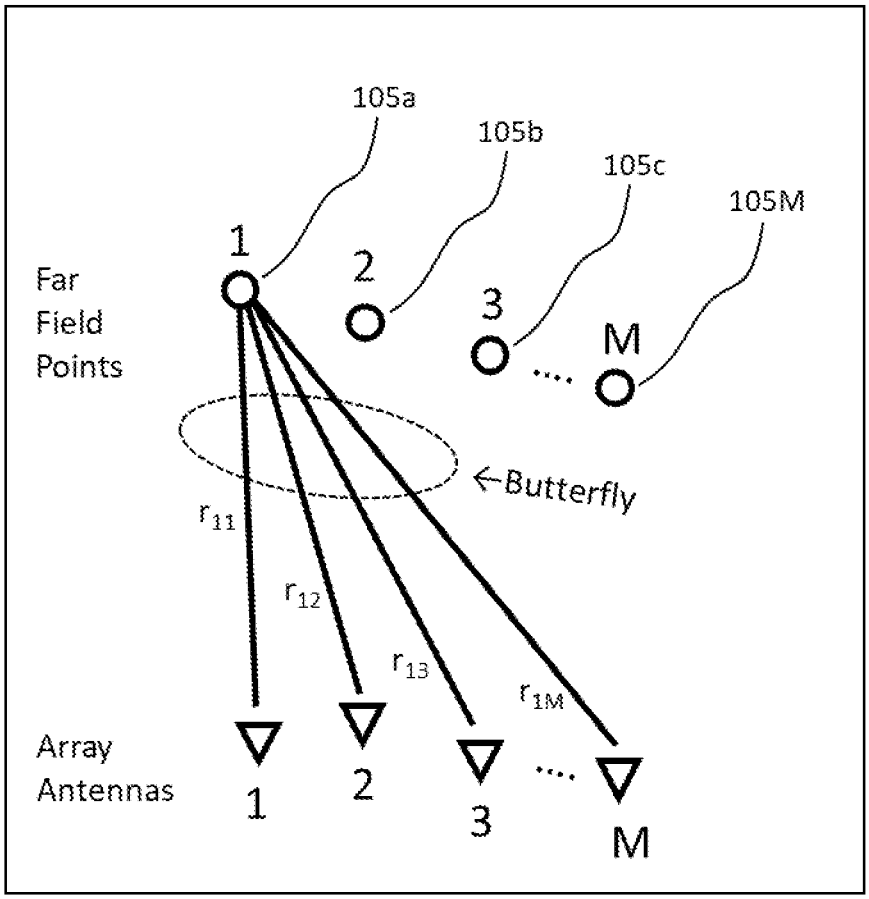
FIG. 8 illustrates the set of ranges from each antenna to a far field point.

The weighted voltage at Far Field Point #1, shown by FIG. 8, is expressed as:

$$V_1(f,t)=h_1\frac{1}{r_{11}}e^{(kr_{11}+\omega t)}+h_2\frac{1}{r_{12}}e^{(kr_{12}+\omega t)}+\ldots+h_M\frac{1}{r_{1M}}e^{(kr_{1M}+\omega t)}$$

FIG. 8 illustrates the set of ranges $r_{ij}$ from each antenna, to far field point #1, 105*a*. The total field at far field point #1, 105*a*, is the summation of the fields generated from the multiplicity of antennas, 101*a* through 101*m*, with respective ranges $r_{11}, r_{12}, \ldots r_{1M}$. This collection of ranges to a single point can be denoted as a "butterfly". It is similar to the butterfly used in generating Fast Fourier Transforms (FFT) in Digital Signal Processing.

A finite bandwidth signal, s(t), can be coherently injected into each antenna. Therefore [00061] can be expressed, with s(t), as:

$$s(t)\left\{h_1\frac{1}{r_{11}}e^{j(kr_{11}+\omega t)}+h_2\frac{1}{r_{12}}e^{j(kr_{12}+\omega t)}+\ldots+h_M\frac{1}{r_{1M}}e^{j(kr_{1M}+\omega t)}\right\}=V_1$$

Figure 9:
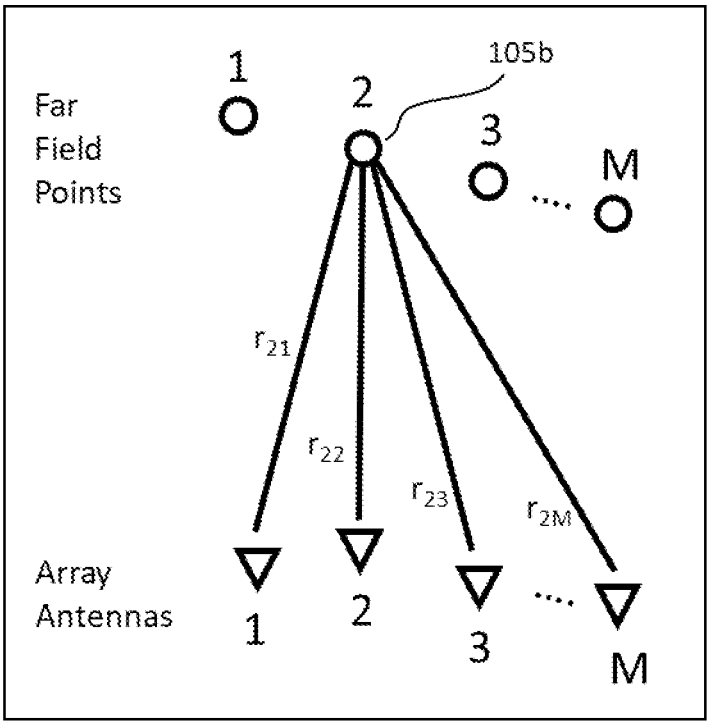
FIG. 9 shows that the same weights can be used to force voltage at a second (arbitrarily chosen) point in the far field.

The same weights, $h=[h_1, h_2, \ldots h_M]$, can be used to force a voltage at the second (arbitrarily chosen) point, shown by FIG. 9, in the far field with:

$$s(t)\left\{h_1\frac{1}{r_{21}}e^{j(kr_{21}+\omega t)}+h_2\frac{1}{r_{22}}e^{j(kr_{22}+\omega t)}+\ldots+h_M\frac{1}{r_{2M}}e^{j(kr_{2M}+\omega t)}\right\}=V_2$$

FIG. 9 illustrates the set of ranges $r_{ii}$ from all antennas, to far field point #2, 105*b*. The total field at far field point #2, 105*b*, is the summation of the fields generated from the multiplicity of antennas, 101*a* through 101*m*. The total field at far field point #2, 105*b*, is the summation of the fields generated from the multiplicity of antennas, 101*a* through 101*m*, with respective ranges $r_{21}, r_{22}, \ldots r_{2M}$. This is another butterfly, with ranges from all antennas, yet to different far field point, 105*b*.

This can be continued, to the $M^{th}$ far field point, as:

$$s(t)\left\{h_1\frac{1}{r_{M1}}e^{j(kr_{M1}+\omega t)}+h_2\frac{1}{r_{M2}}e^{j(kr_{M2}+\omega t)}+\ldots+h_M\frac{1}{r_{MM}}e^{j(kr_{MM}+\omega t)}\right\}=V_M$$

The relationships in [00064], [00066],through [00069] can be expressed in matrix form as:

$$s(t)\begin{bmatrix}\frac{1}{r_{11}}e^{j(kr_{11}+\omega t)} & \frac{1}{r_{12}}e^{j(kr_{12}+\omega t)} & \ldots & \frac{1}{r_{1M}}e^{j(kr_{1M}+\omega t)}\\ \frac{1}{r_{21}}e^{j(kr_{21}+\omega t)} & \frac{1}{r_{22}}e^{j(kr_{22}+\omega t)} & \ldots & \frac{1}{r_{M2}}e^{j(kr_{2M}+\omega t)}\\ \frac{1}{r_{M1}}e^{j(kr_{M1}+\omega t)} & \frac{1}{r_{M2}}e^{j(kr_{M2}+\omega t)} & \ldots & \frac{1}{r_{MM}}e^{j(kr_{MM}+\omega t)}\end{bmatrix}\begin{bmatrix}h_1\\h_2\\\vdots\\h_M\end{bmatrix}=s(t)e^{j\omega t}\begin{bmatrix}V_1\\V_2\\\vdots\\V_M\end{bmatrix}$$

Figure 10:
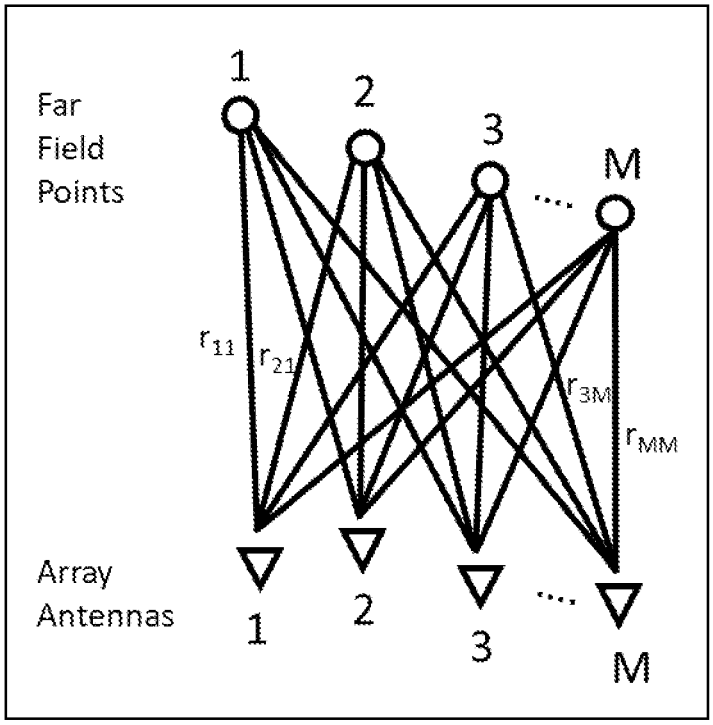
FIG. 10 illustrates the collection of "butterflies", from all antennas, to the respective far field points.

This embodiment can be represented by the drawing in FIG. 10. FIG. 10 illustrates the collection of "butterflies", from all antennas, to the respective far field points, 105*a* through 105*m*.

It should be noted that the message signal, s(t), can be literally be any (modulated) signal with finite bandwidth. This can include a Digital Radio Frequency Memory (DRFM) signal.

Notice that since all signals are coherently RF converted, with synchronized initial phases, then the time dependence is the same for all components. This time dependence can be removed from all matrix values, to a constant multiplied by the matrix, expressed as:

$$(s(t)e^{(j\omega t)})\begin{bmatrix}\frac{1}{r_{11}}e^{jkr_{11}} & \frac{1}{r_{12}}e^{jkr_{12}} & \ldots & \frac{1}{r_{1M}}e^{jkr_{1M}}\\ \frac{1}{r_{21}}e^{jkr_{21}} & \frac{1}{r_{22}}e^{jkr_{22}} & \ldots & \frac{1}{r_{2M}}e^{jkr_{2M}}\\ \frac{1}{r_{M1}}e^{jkr_{M1}} & \frac{1}{r_{M2}}e^{jkr_{M2}} & \ldots & \frac{1}{r_{MM}}e^{jkr_{MM}}\end{bmatrix}\begin{bmatrix}h_1\\h_2\\\vdots\\h_M\end{bmatrix}=(s(t)e^{(j\omega t)})\begin{bmatrix}V_1\\V_2\\\vdots\\V_M\end{bmatrix}$$

The expression in [00075] can be rewritten in compact form as:

$$s(t)e^{j\omega t}R_{xx}h=s(t)e^{j\omega t}V$$

or $R_{xx}h=V$

Solving for h:

$h=R_{xx}^{-1}V$

It should be noted, and without loss of generality there are numerous methods to solve for the optimize weights in [00079]. Relationship [00081] is simply the direct method, where the inverse of $R_{xx}$ has been used to solve directly for the complex weights, h. However, there are many other methods, including Time Adaptive Processing, as well as using a Genetic Algorithm.

Up to this point, all transfer functions, and signal modeling have assumed a narrowband approximation. However, the inventor has now extended the Wave Mechanics mechanism of plane wave rotation, or shaping of both far field and near field waves, to a fully wideband model. This model not only includes signal bandwidths that are greater than 1 percent of the RF Carrier frequency, but can be extended to any signal bandwidth that can be "carried" by an RF signal.

Let n represent a spatial point (n=1, . . . , N), and m represent a source antenna (m=1, . . . . , M).

We can see that the from [00075], [00077], and [00079], that the row components of the $R_{xx}$ matrix comprise the collection of sources (m=1, . . . , M) and the column components of the $R_{xx}$ matrix comprise the collection of far field (or near-field) points (n=1, . . . , N).

$$(s(t)e^{(j\omega t)})\begin{bmatrix} \frac{1}{r_{11}}e^{jkr_{11}} & \frac{1}{r_{12}}e^{jkr_{12}} & \dots & \frac{1}{r_{1M}}e^{jkr_{1M}} \\ \frac{1}{r_{21}}e^{jkr_{21}} & \frac{1}{r_{22}}e^{jkr_{22}} & \dots & \frac{1}{r_{2M}}e^{jkr_{2M}} \\ \frac{1}{r_{M1}}e^{jkr_{M1}} & \frac{1}{r_{2M}}e^{jkr_{M2}} & \dots & \frac{1}{r_{MM}}e^{jkr_{MM}} \end{bmatrix}\begin{bmatrix} h_1 \\ h_2 \\ \vdots \\ h_M \end{bmatrix} = (s(t)e^{(j\omega t)})\begin{bmatrix} V_1 \\ V_2 \\ \vdots \\ V_M \end{bmatrix}$$

The expression in [00086] can be rewritten in compact form as:

$$s(t)e^{j\omega t}R_{xx}h=s(t)e^{j\omega t}V$$

or $$R_{xx}h=V$$

We can re-write [00086] for each row of the system, using a summation, as:

$$s(t)e^{jw_0t}\sum_{m=1}^{M}e^{+jkr_{nm}}\cdot h_m = s(t)e^{jw_0t}V_n$$

thus $$\sum_{m=1}^{M}e^{+jkr_{nm}}\cdot h_m = V_n$$

Where the summation of weighted fields represents that field response at each point n=1, . . . , N.

We can see that [00090] can be alternate expressed as the multiplication of an N×M matrix, of range wave functions, multiplied by an M×1 vector of complex weights results in an N×1 vector of far field (or near field) responses.

or $$\begin{bmatrix} e^{jkr_{11}} & e^{jkr_{12}} & \dots & e^{jkr_{1M}} \\ \vdots & & & \\ e^{jkr_{N1}} & e^{jkr_{N2}} & \dots & e^{jkr_{NM}} \end{bmatrix}\begin{bmatrix} h_1 \\ \vdots \\ h_M \end{bmatrix} = \begin{bmatrix} V_1 \\ \vdots \\ V_N \end{bmatrix}$$

$$N\times M \qquad M\times 1 \qquad N\times 1$$

Assume now a wideband signal, s(t), that is fed into each antenna in the source array. As before, we will want this signal to form an output, represented by:

output=h(t·s(t)

The simple [complex] Discrete Fourier Transform (DFT) of the (wideband) signal can be represented as:

$$S_f = \sum_{n=\phi}^{N-1}s_ne^{-j\frac{2\pi fn}{N}}$$

Where we have changed nomenclatures to adhere to conventional DSP terms and Digital constructs, such that:

n≡index of data samples (or the sample number in time)

N≡number of samples per DFT

F≡frequency index (integer)

F=0, 1, 2, . . . , N−1

Or the frequency of each [complex] DFT spectral bin.

Figure 11:
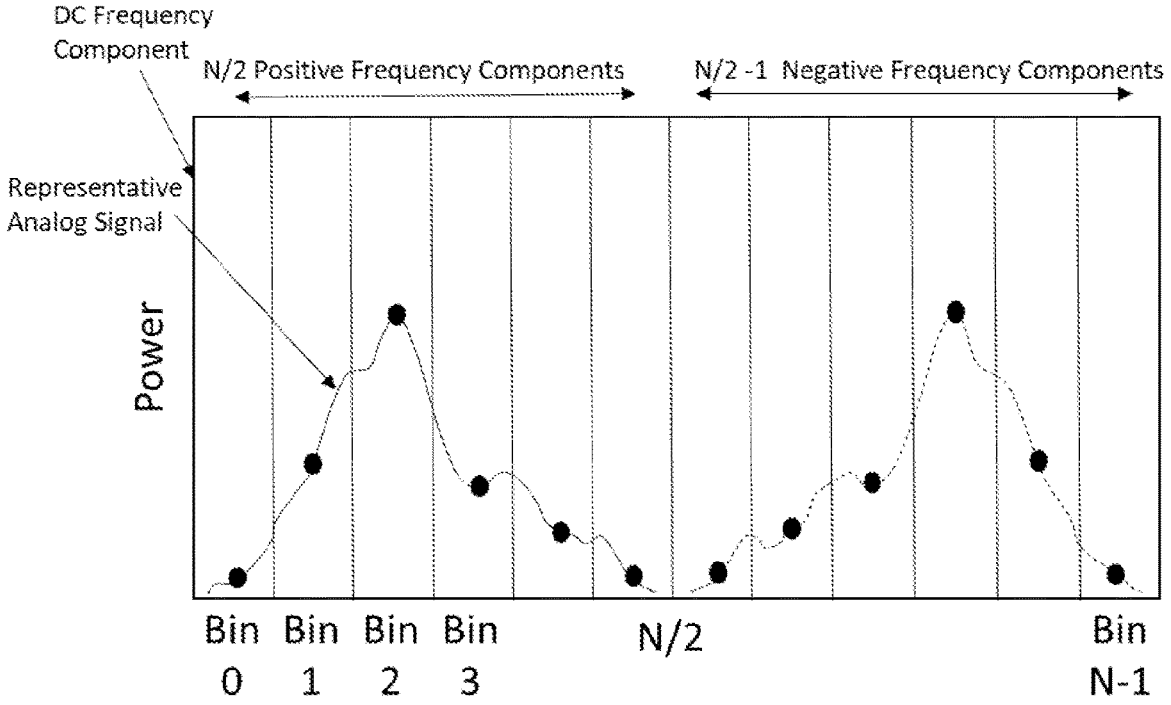
FIG. 11 shows the Complex DFT of the continuous time signal.

FIG. 11 shows the Complex DFT of the continuous time signal, s(t). The image of the signal, from the N/2 Positive Frequency Components, or Positive Frequency Bins, has been imaged over to the Negative Frequency Components, or Negative Frequency Bins. Note that the actual [complex] DFT signal is represented by the "dot" in each bin. That is, since the signal is now digital, it is not continuous, but represented as a collection of spectral points.

The Goal of the Wideband Wave Mechanics technique is to break up the continuous signal spectral composition into components of [Complex] Discrete Frequency (Frequency Bins), and then to operate on each DFT Bin, one by one, to extract a representative weight vector, h, as a function of frequency, h(f) or $h_f$.

Assume a set of array weights, $h_f$, one for each frequency bin f. These are currently, unknown values.

Similar to our narrowband representation of:

output to antennas=$h(t)\cdot s(t)$

Where the narrowband signal is multiplied by a single M×1 vector of weights, directed to each transmit antenna. The desired wideband output signal for the array, which includes weights within each spectral bin, f, can be represented as:

$$\underline{W}_n = \frac{1}{N}\sum_{f=0}^{N-1}\underline{h}_fS_fe^{+\frac{2\pi fn}{N}}$$

Notice that $W_n$ is the Inverse DFT for the wideband signal output, fully weighted across all frequencies, which is then output to the same antennas, as [000100]. The discrete frequency response, for the time series analog signal s(t), $S_f$, is now multiplied at each frequency Bin by the conjugate spectral Bin weights, $h_f$, to obtain the Inverse DFT, which is again back in the time domain. This is the output, from the Processing (FPGAs) which would be sent to the transmitter (multi-Channel) exciters.

To obtain the delay vectors, $h_f$, for each spectral bin f=0, 1, . . . , N−1 , we can treat each bin as a narrowband system. Thus, within each spectral bin, f:

$$R_f\cdot\underline{h}_f = \underline{V}_f$$

where $$\underline{V}_f = \sum_{n=0}^{N-1}\underline{V}_ne^{-j\frac{2\pi fn}{N}}$$

And $$n = 0, 1, \dots, N-1$$

$$f = 0, 1, \dots, N-1$$

As with the narrowband solution, our goal will be that all far field points will have the same or similar value. Thus along our rotated line, all points will have the same phase and same amplitude.

Thus $$\underline{V}_n = \begin{bmatrix} 1 \\ 1 \\ 1 \\ 1 \\ 1 \end{bmatrix} \text{ for all } N \text{ samples.}$$

Note that $V_n$ is a N×1 vector of unity (ones) components.

[000129] It should be noted, and without loss of generality, that this $V_n$ only represents one of an infinite possible choice of shaping and field values.

Then:

$$\underline{V}_f = \underline{V}_n \sum_{n=0}^{N-1} e^{-j\frac{2\pi fn}{N}}$$

Which would also imply that all $V_f$, f=0, 1, . . . , N−1 are also the same.

Thus $V_f$=constant·$V_n$

Therefore, $$\begin{aligned} R_f \cdot \underline{h}_f &= \underline{V}_f \\ &= \text{constant} \cdot \underline{V}_n \\ &= \text{constant} \cdot \begin{bmatrix} 1 \\ 1 \\ 1 \\ 1 \\ 1 \end{bmatrix} \end{aligned}$$

For the narrow band case of:

$R_{xx}$ h=V each component in $R_{xx}$ uses the same frequency, embedded in k=2π/λ:

$$\begin{bmatrix} \frac{1}{r_{11}} e^{jkr_{11}} & \frac{1}{r_{12}} e^{jkr_{12}} & \dots & \frac{1}{r_{1M}} e^{jkr_{1M}} \\ \frac{1}{r_{21}} e^{jkr_{21}} & \frac{1}{r_{22}} e^{jkr_{22}} & \dots & \frac{1}{r_{2M}} e^{jkr_{2M}} \\ \frac{1}{r_{M1}} e^{jkr_{M1}} & \frac{1}{r_{M2}} e^{jkr_{M2}} & \dots & \frac{1}{r_{MM}} e^{jkr_{MM}} \end{bmatrix} \begin{bmatrix} h_1 \\ h_2 \\ \vdots \\ h_M \end{bmatrix} = \begin{bmatrix} V_1 \\ V_2 \\ \vdots \\ V_M \end{bmatrix}$$

The wavenumber, k, in each exponent in $R_{xx}$, can be written as:

$$k = \frac{2 \cdot \pi}{\lambda} = \frac{2 \cdot \pi \cdot \text{frequency}}{c}$$

Where c=speed of light.

Therefore, in the narrowband model, the representation of $R_{xx}$ uses the same frequency, and thus h operates only over a narrowband frequency range.

However, the expression in [000115] uses an $h_f$, that can be very different from frequency to frequency (e.g. across different frequency Bins).

Note that each $R_f$, for each of the different frequency bins: f=0, 1, . . . , N−1 can be represented as:

$$R_f = \begin{bmatrix} e^{j\frac{2\pi(f+f_0)}{c} r_{11}} & \dots & e^{j\frac{2\pi(f+f_0)}{c} r_{1M}} \\ e^{j\frac{2\pi(f+f_0)}{c} r_{N1}} & \dots & e^{j\frac{2\pi(f+f_0)}{c} r_{NM}} \end{bmatrix}$$

Then $R_f$ is computed for each f=0, 1, . . . , N−1 and carrier frequency of the center of the signal, $f_0$. It is important to include the carrier frequency center, $f_0$, since the Wave Mechanics technique operates at the carrier frequency level.

Then using each $R_f$ and $V_f$, we solve for each $h_f$, f=0, 1, . . . , N−1 either directly, or using an Adaptive Filter, or via a Genetic Algorithm.

Finally, using the computed $S_f$ and $h_f$, for each frequency Bin: f=Ø, 1, . . . , N−1 we generate the array data samples (time domain response) for each block of N samples, using the Inverse DFT:

$$\underline{W}_n = \frac{1}{N} \sum_{f=0}^{N-1} \underline{h}_f S_f e^{+\frac{2\pi fn}{N}}$$

It should be noted, that both the narrowband and wideband techniques work for almost any arrangement and orientation of source antennas and arrays:

a) Single Ship model, where all antennas 1, . . . , M are co-located together, and b) Dual or Multi-Ship model, where the source antennas can be distributed amongst a plurality of platforms and/or separate locations.

REFERENCES (INCORPORATED HEREIN BY REFERENCE)

Judd, M. (2018) U.S. patent application Ser. No. 15,934563

What is claimed is:

1. A wave mechanics method that generates a time domain signal for transmission wherein:

the time domain signal is input into each antenna channel in a phased array system, a wideband frequency response is produced for a wideband desired input signal, for wave construction for controlling, rotating, or shaping radio frequency or acoustic waves comprising:

utilizing a multiplicity of points in the far field to set electric field voltages and phases at these points which is then used with equation $$\begin{bmatrix} e^{jkr_{11}} & e^{jkr_{12}} & \dots & e^{jkr_{1M}} \\ \vdots & & & \\ e^{jkr_{N1}} & e^{jkr_{N2}} & \dots & e^{jkr_{NM}} \end{bmatrix}_{N \times M} \begin{bmatrix} h_1 \\ \vdots \\ h_M \end{bmatrix}_{M \times 1} = \begin{bmatrix} V_1 \\ \vdots \\ V_N \end{bmatrix}_{N \times 1}$$

to compute a single set of M complex array weights, h, for a multiplicity of M RF source array antennas, or acoustic transducers;

defining the electric field voltages and phases at these points emulating a same equipotential voltage and phase characteristics as a natural expanding wave, but either rotated or wrapped onto a different virtual surface;

generating a signal for each of the M RF source antennas that when combined in the far field produce a rotated or reshaped wavefront with wide rotation window or corridor, generated with a same message signal content of a transmission from a single source; then transmitting a complex signal from each antenna, formed from multiplication of the computed array antenna weights multiplied by an original desired message and carrier signal; and resulting in a new combined outgoing signal with a rotated wavefront angle not being perpendicular to the direction or location of the transmitting source array, that achieves wave rotation or shaping in the near field as well as the far field for a narrowband signal model only, i.e. less than 1% of the carrier frequency; and the wavefront for the wideband signal is rotated or shaped in either the near field or the far field.

2. The method of claim 1 wherein a multiplicity of (M) RF antennas, or acoustic transducers, and a collection of points in the far field or near field, a single set of M complex weights, h, for each frequency bin in a Discrete Fourier Transform (DFT) of the original signal.

3. The method of claim 1 wherein the far field wave is able, for a wideband signal, to be manipulated such that impinging wavefronts at the target or receive antenna or array, are not orthogonal, or perpendicular, to the direction of propagation enabling rotation of the far field or near field wavefront as well as shaping of a wave front.

4. The method of claim 1 wherein the time domain signal model is extended to a Wideband Signal domain, and uses a Discrete Fourier Transform (DFT) to compute the array weights, independently for each frequency bin, and then the set of N frequency weight vectors are used in an inverse Fourier Transform to produce a radiating time domain signal which is constructed for a phased array system of M antennas, or transducers; for acoustics, such that the far field wave at a given point is rotated by a predetermined or computed angle, (β), or the wave front is re-shaped, over any wideband signal bandwidth.

5. The method of claim 1 wherein the multiplicity of M RF source array antenna elements are each fed by a coherent, in phase, RF converted signal, and the M antennas can be placed on two or more platforms or separated locations, without the need for co-location.

6. The method of claim 1 wherein a source signal generator produces a digital signal that is processed by a DSP processing block, forwarding each antenna signal to a Digital to RF converter block.

7. The method of claim 1 wherein DFT of a wideband signal is first computed for N frequency bins from N data samples, and uses a narrowband wave mechanics method to compute the R-Matrix, $R_f$, for each frequency bin, whereas $R_f$ is computed for each f=0, 1, . . . , N−1 and carrier frequency of the center of the signal, $f_0$, and the inclusion of carrier frequency center $f_0$ is important since the wave mechanics technique operates at the carrier frequency level, next a set of weights, $h_f$, is computed for each frequency bin, using either an inverse matrix approach, or genetic algorithm using the R-Matrix and the desired voltage response vector, $V_f$, then the inverse DFT is computed to obtain the time domain signal vector, $W_n$, for each data sample n, via multiplication of the frequency domain signal and the frequency weight $h_f$, from each frequency bin, in which $W_n$ is the Inverse DFT for the wideband signal output, fully weighted across all frequencies, and a new time domain signal vector, $W_n$, is fed into each antenna channel, which becomes the output from the Processing (FPGAs) that would be sent to the transmitter (multi-Channel) exciters.

* * * * *